US011939975B2

(12) United States Patent
Patoskie

(10) Patent No.: US 11,939,975 B2
(45) Date of Patent: Mar. 26, 2024

(54) SUCTION COVER ASSEMBLY FOR RECIPROCATING PUMPS

(71) Applicant: SPM Oil & Gas Inc., Fort Worth, TX (US)

(72) Inventor: Renae Patoskie, Allen, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 374 days.

(21) Appl. No.: 17/296,971

(22) PCT Filed: Sep. 30, 2019

(86) PCT No.: PCT/US2019/053759
§ 371 (c)(1),
(2) Date: May 25, 2021

(87) PCT Pub. No.: WO2020/112235
PCT Pub. Date: Jun. 4, 2020

(65) Prior Publication Data

US 2021/0404464 A1 Dec. 30, 2021

Related U.S. Application Data

(60) Provisional application No. 62/771,565, filed on Nov. 26, 2018.

(51) Int. Cl.
*F04B 53/22* (2006.01)
*F04B 53/16* (2006.01)
*F04B 47/00* (2006.01)

(52) U.S. Cl.
CPC ..... *F04B 53/22* (2013.01); *F04B 53/16* (2013.01); *F04B 47/00* (2013.01)

(58) Field of Classification Search
CPC ..... F04B 47/00; F04B 53/16; F04B 53/22
See application file for complete search history.

(56) References Cited

U.S. PATENT DOCUMENTS

| | | | | |
|---|---|---|---|---|
| 1,929,310 | A | 10/1933 | Greve | |
| 3,327,643 | A * | 6/1967 | Pangburn | F04B 53/168 92/171.1 |
| 7,506,574 | B2 * | 3/2009 | Jensen | F04B 53/007 417/454 |
| 11,578,710 | B2 * | 2/2023 | Nowell | F04B 39/10 |
| 2009/0235701 | A1 * | 9/2009 | Lin | A47J 41/0011 70/165 |

(Continued)

OTHER PUBLICATIONS

International Search Report and Written Opinion received in Patent Cooperation Treaty Application No. PCT/US2019/053759, dated Dec. 31, 2019.

*Primary Examiner* — Thomas E Lazo

(57) ABSTRACT

A suction cover for a reciprocating pump assembly includes a plug configured to be at least partially received within an access port of a fluid cylinder of the reciprocating pump assembly. The plug includes at least one key configured to be received through a keyhole of the access port such that the at least one key extends within a keyway of the access port when the plug is at least partially received within the access port. The plug is configured to be rotated within the access port between an unlocked position wherein the at least one key is aligned with the keyhole and a locked position that prevents the plug from backing out of the access port.

20 Claims, 8 Drawing Sheets

(56) References Cited

U.S. PATENT DOCUMENTS

| | | | | |
|---|---|---|---|---|
| 2010/0054974 | A1 | 3/2010 | Riley et al. | |
| 2015/0184784 | A1 | 7/2015 | Chisholm et al. | |
| 2016/0245280 | A1* | 8/2016 | Todorov | F04B 53/10 |

* cited by examiner

SUCTION COVER ASSEMBLY FOR RECIPROCATING PUMPS

CROSS-REFERENCE TO RELATED APPLICATION

This application is a national phase application of Patent Cooperation Treaty Application No. PCT/US2019/053759 filed Sep. 30, 2019, which claims priority to U.S. Provisional Application No. 62/771,565 filed Nov. 26, 2018, which is incorporated herein by reference in their entirety.

TECHNICAL FIELD

This disclosure relates to reciprocating pumps, and, in particular, to suction covers used in reciprocating pumps.

BACKGROUND

In oilfield operations, reciprocating pumps are used for different applications such as fracturing subterranean formations to drill for oil or natural gas, cementing the wellbore, or treating the wellbore and/or formation. A reciprocating pump designed for fracturing operations is sometimes referred to as a "frac pump." A reciprocating pump typically includes a power end section and a fluid end section. The fluid end section can be formed of a one piece construction or a series of blocks secured together by rods. The fluid end section includes a fluid cylinder (sometimes referred to as a cylinder section or a fluid end block) having a plunger bore for receiving a plunger, an inlet fluid passage, an outlet fluid passage (sometimes referred to as a discharge passage), and an access port. The inlet and outlet passages each include a valve assembly to control the flow of fluid into and out of the fluid cylinder. For example, the valve assemblies can be differential pressure valves that are opened by differential pressure of fluid and allow the fluid to flow in only one direction through the corresponding inlet or outlet passage.

The access port of reciprocating pumps is used to service the plunger and valve assemblies of the reciprocating pump, for example during field use where rapid maintenance and/or replacement may be important for the profitability of a well service operation. In the fluid cylinder of a reciprocating pump, the access port may be closed using a suction cover that is held in place with a suction cover nut that is threadedly connected to the fluid cylinder, for example using buttress threads. But, despite the selection of relatively strong materials and the use of double shot peening and/or other hardening techniques, the relatively high cyclical loads on the suction cover may cause the threads to fatigue and ultimately fail. For example, the relatively high cyclical loads exerted on the suction cover nut during cyclical pumping of the reciprocating pump may impart an unequal load distribution along the axial length of the threads, may cause the threads of suction cover nuts and/or fluid cylinders to "cone out" and/or peel off, and/or may cause the suction cover nut to back out of the access port. Failure of the threaded connection between the suction cover nut and the fluid cylinder may cause the reciprocating pump to leak at the access port (e.g., the suction cover nut may weep well service fluid to the atmosphere through the threads) and/or may necessitate costly replacement of the suction cover nut and/or the fluid cylinder. Moreover, the threads may become dirty during field use of reciprocating pumps, which may hasten failure of the threads. The resulting maintenance operations required to clean the thread forms may increase the cost of maintaining reciprocating pumps.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a suction cover for a reciprocating pump assembly includes a plug configured to be at least partially received within an access port of a fluid cylinder of the reciprocating pump assembly. The plug includes at least one key configured to be received through a keyhole of the access port such that the at least one key extends within a keyway of the access port when the plug is at least partially received within the access port. The plug is configured to be rotated within the access port between an unlocked position wherein the at least one key is aligned with the keyhole and a locked position that prevents the plug from backing out of the access port.

In some embodiments, the at least one key is configured to be at least partially misaligned with the keyhole in the locked position of the plug.

In some embodiments, the locked position of the plug is configured such that a sidewall of the keyway of the access port blocks the at least one key from backing out of the access port in the locked position of the plug.

In some embodiments, the at least one key is configured to interlock the plug with the access port in the locked position of the plug.

In some embodiments, the plug extends a length along a central longitudinal axis. The at least one key extends radially outward from the plug relative to the central longitudinal axis.

In some embodiments, the plug extends a length along a central longitudinal axis. The suction cover further includes a locking cuff that is configured to be received through the keyhole of the access port when the plug is in the locked position such that the locking cuff extends within the keyway of the access port. The locking cuff is configured to block the at least one key from rotating about the central longitudinal axis in at least one direction when the locking cuff extends within the keyway of the access port.

In some embodiments, the at least one key includes first and second keys that are spaced apart along a circumference of the plug by a recess defined between the first and second keys. The keyhole of the access port includes first and second keyholes. The recess is configured to receive an extension of the access port therethrough as the first and second keys are received through the first and second keyholes, respectively.

In a second aspect, a fluid end section for a reciprocating pump assembly includes a fluid cylinder that includes a pressure chamber and an access port. The access port extends into the fluid cylinder along a central longitudinal axis. The access port includes a circumferential groove and an axial opening that intersects the circumferential groove. The fluid end section includes a suction cover that includes a plug configured to be at least partially received within the access port of the fluid cylinder. The plug includes at least one protrusion configured to be received through the axial opening of the access port such that the at least one protrusion extends within the circumferential groove of the access port when the plug is at least partially received within the access port. The plug is configured to be rotated within the access port between an unlocked position wherein the at least one protrusion is aligned with the axial opening and a locked position that prevents the plug from backing out of the access port.

In some embodiments, the central longitudinal axis of the access port is a central longitudinal port axis. The plug of the suction cover extends a length along a central longitudinal plug axis. The at least one protrusion extends radially outward from the plug relative to the central longitudinal plug axis.

In some embodiments, the access port of the fluid cylinder includes an inner wall of the fluid cylinder. The circumferential groove of the access port extends radially into the inner wall relative to the central longitudinal axis of the access port.

In some embodiments, the axial opening of the access port extends a length through the fluid cylinder that is approximately parallel to the central longitudinal axis of the access port.

In some embodiments, the circumferential groove of the access port includes a sidewall that blocks the at least one protrusion of the suction cover from backing out of the access port in the locked position of the plug.

In some embodiments, the suction cover further includes a locking cuff that is configured to be received through the axial opening of the access port when the plug is in the locked position such that the locking cuff extends within the circumferential groove of the access port, The locking cuff is configured to block the at least one protrusion from rotating about the central longitudinal axis in at least one direction when the locking cuff extends within the circumferential groove of the access port.

In a third aspect, a fluid end section for a reciprocating pump assembly includes a fluid cylinder that includes a pressure chamber and an access port. The access port includes a keyway and a keyhole that intersects the keyway. The fluid end section includes a suction cover that includes a plug configured to be at least partially received within the access port of the fluid cylinder. The plug includes at least one key configured to be received through the keyhole of the access port such that the at least one key extends within the keyway of the access port when the plug is at least partially received within the access port. The plug is configured to be rotated within the access port between an unlocked position wherein the at least one key is aligned with the keyhole of the access port and a locked position wherein the at least one key is at least partially misaligned with the keyhole.

In some embodiments, the keyway of the access port includes a sidewall that blocks the at least one key of the suction cover from backing out of the access port in the locked position of the plug of the suction cover.

In some embodiments, the plug of the suction cover extends a length along a central longitudinal axis. The at least one key of the suction cover extends radially outward from the plug relative to the central longitudinal axis.

In some embodiments, the suction cover further includes a locking cuff that is configured to be received through the keyhole of the access port when the plug is in the locked position such that the locking cuff extends within the keyway of the access port. The locking cuff is configured to hold the plug in the locked position when the locking cuff extends within the keyway of the access port.

In some embodiments, the at least one key of the suction cover includes first and second keys that are spaced apart along a circumference of the plug of the suction cover by a recess defined between the first and second keys. The keyhole of the access port includes first and second keyholes. The recess is configured to receive an extension of the access port therethrough as the first and second keys are received through the first and second keyholes, respectively.

In some embodiments, the access port of the fluid cylinder extends into the fluid cylinder along a central longitudinal axis. The access port includes an inner wall of the fluid cylinder. The keyway of the access port extends radially into the inner wall relative to the central longitudinal axis of the access port.

In some embodiments, the access port of the fluid cylinder extends into the fluid cylinder along a central longitudinal axis. The keyhole of the access port extends a length through the fluid cylinder that is approximately parallel to the central longitudinal axis of the access port.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

Corresponding reference characters indicate corresponding parts throughout the drawings.

DETAILED DESCRIPTION

Certain embodiments of the disclosure provide a suction cover for a reciprocating pump assembly. The suction cover includes a plug configured to be at least partially received within an access port of a fluid cylinder of the reciprocating pump assembly. The plug includes at least one key configured to be received through a keyhole of the access port such that the at least one key extends within a keyway of the access port when the plug is at least partially received within the access port. The plug is configured to be rotated within the access port between an unlocked position wherein the at least one key is aligned with the keyhole and a locked position that prevents the plug from backing out of the access port.

Certain embodiments of the disclosure eliminate a threaded connection between a suction cover assembly and a fluid cylinder of a reciprocating pump assembly. Certain embodiments of the disclosure provide a reciprocating pump assembly that may require less service and/maintenance, which may limit the downtime of the reciprocating pump assembly and/or reduce costs thereby improving the profitability of a well service or other operation utilizing the reciprocating pump assembly.

Figure 1:
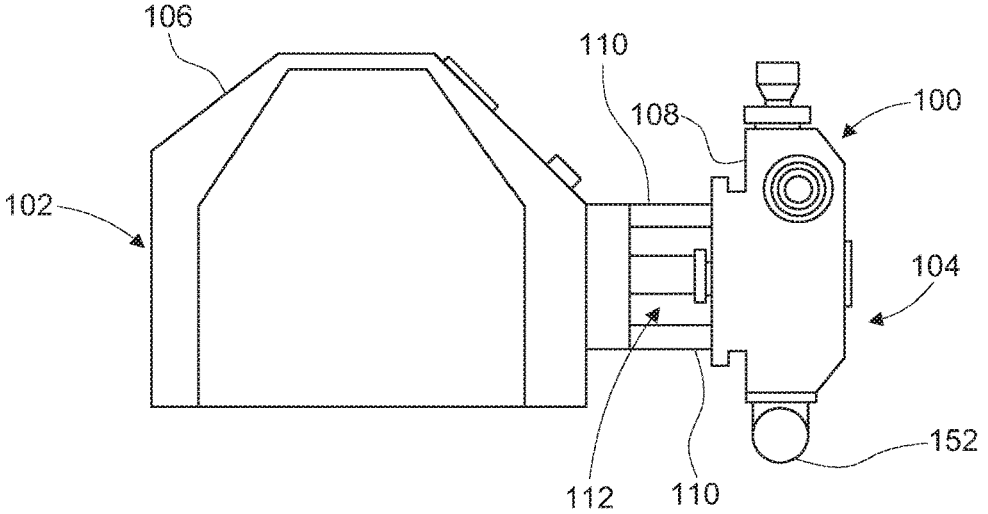
FIG. 1 is an elevational view of a reciprocating pump assembly according to an exemplary embodiment.

Referring to FIG. 1, an illustrative embodiment of a reciprocating pump assembly 100 is presented. The reciprocating pump assembly 100 includes a power end section 102 and a fluid end section 104 operably coupled thereto. The power end section 102 includes a housing 106 in which a crankshaft (not shown) is disposed. Rotation of the crankshaft is driven by an engine or motor (not shown) of the power end section 102. The fluid end section 104 includes a fluid cylinder 108 (sometimes referred to as a "fluid end block" or a "cylinder section"), which in the exemplary embodiments is connected to the housing 106 via a plurality of stay rods 110. Other structures may be used to connect the fluid end section 104 to the housing 106 in addition or alternatively to the stay rods 110. In operation, the crankshaft reciprocates a plunger rod assembly 112 between the power end section 102 and the fluid end section 104 to thereby pump (i.e., move) fluid through the fluid cylinder 108.

According to some embodiments, the reciprocating pump assembly 100 is freestanding on the ground, mounted to a trailer for towing between operational sites, mounted to a skid, loaded on a manifold, otherwise transported, and/or the like. The reciprocating pump assembly 100 is not limited to frac pumps or the plunger rod pump shown herein. Rather, the embodiments disclosed herein may be used with any other type of pump that includes a suction cover.

Figure 2:
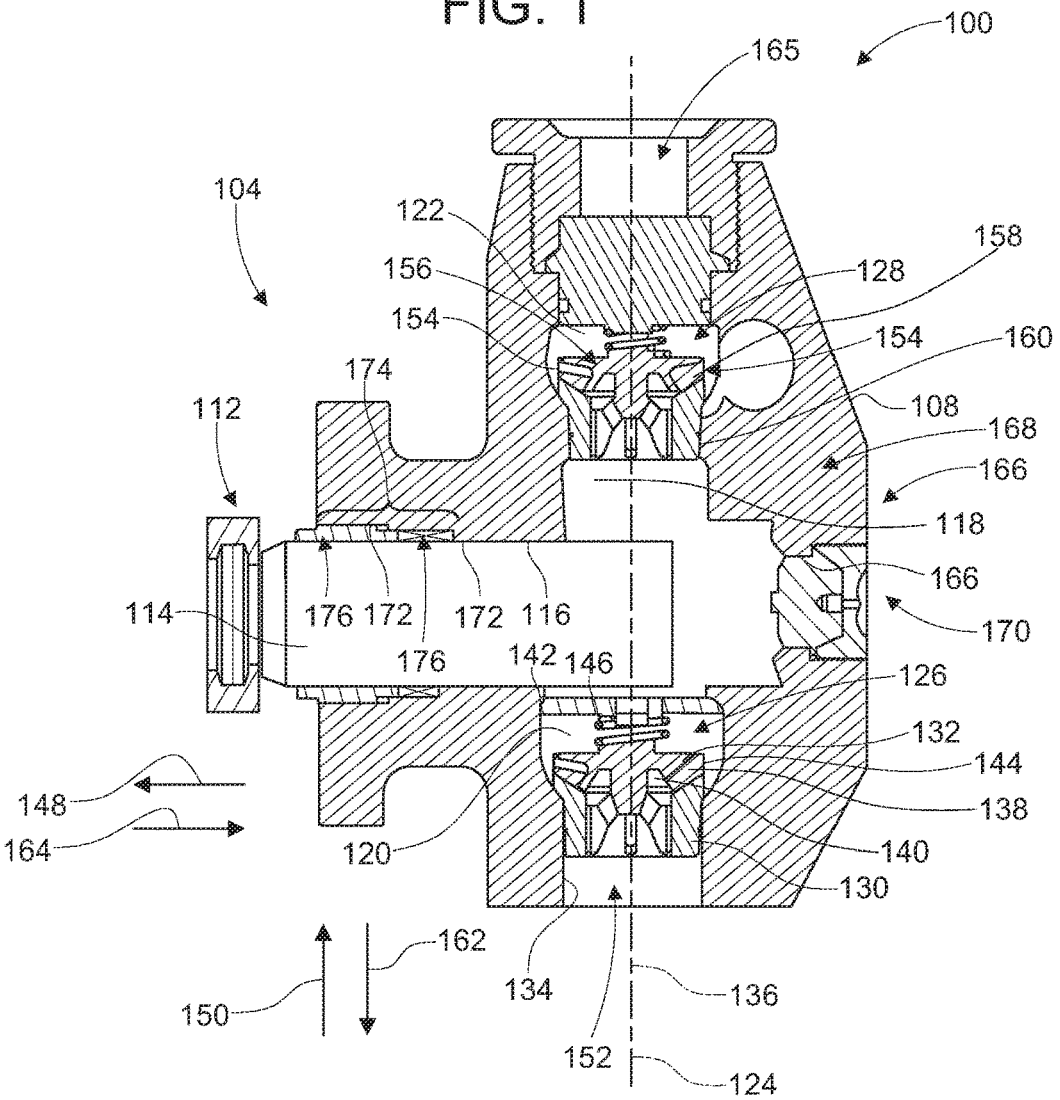
FIG. 2 is a cross-sectional view of a fluid end section of the reciprocating pump assembly shown in FIG. 1 according an exemplary embodiment.

Referring now to FIG. 2, the plunger rod assembly 112 includes a plunger 114 extending through a plunger bore 116 and into a pressure chamber 118 formed in the fluid cylinder 108. At least the plunger bore 116, the pressure chamber 118, and the plunger 114 together may be characterized as a "plunger throw." According to some embodiments, the reciprocating pump assembly 100 includes three plunger throws (i.e., a triplex pump assembly); however, in other embodiments, the reciprocating pump assembly 100 includes a greater or fewer number of plunger throws.

As shown in FIG. 2, the fluid cylinder 108 includes inlet and outlet fluid passages 120 and 122, respectively, formed therein. Optionally, the inlet and outlet fluid passages 120 and 122, respectively, are coaxially disposed along a fluid passage axis 124, for example as is shown in FIG. 2. Fluid is adapted to flow through the inlet and outlet fluid passages 120 and 122, respectively, and along the fluid passage axis 124. An inlet valve assembly 126 is disposed in the inlet fluid passage 120 and an outlet valve assembly 128 is disposed in the outlet fluid passage 122. In the exemplary embodiments, the valve assemblies 126 and 128 are spring-loaded, which, as described in greater detail below, are actuated by at least a predetermined differential pressure across each of the valve assemblies 126 and 128.

The inlet valve assembly 126 includes a valve seat 130 and a valve member 132 that is configured to be sealingly engaged therewith. The valve seat 130 includes an inlet valve bore 134 that extends along a valve seat axis 136 that is coaxial with the fluid passage axis 124 when the inlet valve assembly 126 is disposed in the inlet fluid passage 120. The valve seat 130 further includes a shoulder 138, which in the exemplary embodiment is tapered (i.e., extends at an oblique angle relative to the valve seat axis 136). In some other examples, the shoulder 138 of the valve seat 130 extends approximately perpendicular to the valve seat axis 136.

The valve member 132 includes a valve head 142 and a tail segment 140 extending from the valve head 142. As shown in FIG. 2, the tail segment 140 is received within the inlet valve bore 134 of the valve seat 130 when the inlet valve assembly 126 is assembled as shown. The valve head 142 includes a seal 144. The valve head 142 of the valve member 132 is moveable relative to the valve seat 130 along the valve seat axis 136 between an open position and a closed position. In the closed position of the valve member 132, the seal 144 of the valve head 142 sealingly engages the valve seat 130 to prevent fluid flow through the inlet valve assembly 126. In the exemplary embodiments, the valve member 132 is engaged and otherwise biased by a spring 146, which, as discussed in greater detail below, biases the valve member 132 to the closed position.

In the embodiments illustrated herein, the outlet valve assembly 128 is substantially similar to the inlet valve assembly 126 and therefore will not be described in further detail herein.

In operation, the plunger 114 reciprocates within the plunger bore 116 for movement into and out of the pressure chamber 118. That is, the plunger 114 moves back and forth horizontally, as viewed in FIG. 2, away from and towards the fluid passage axis 124 in response to rotation of the crankshaft (not shown) that is enclosed within the housing 106 (FIG. 1) of the power end section 102 (FIG. 1). Movement of the plunger 114 in the direction of arrow 148 away from the fluid passage axis 124 and out of the pressure chamber 118 will be referred to herein as the suction stroke of the plunger 114. As the plunger 114 moves along the suction stroke, the inlet valve assembly 126 is opened to the open position of the valve member 132. More particularly, as the plunger 114 moves away from the fluid passage axis 124 in the direction of arrow 148, the pressure inside the pressure chamber 118 decreases, creating a differential pressure across the inlet valve assembly 126 and causing the valve head 142 of the valve member 132 to move (relative to the valve seat 130) upward, as viewed in FIG. 2, along the valve seat axis 136 in the direction of arrow 150. As a result of the upward movement of the valve head 142 of the valve member 132 along the valve seat axis 136, the spring 146 is compressed and the valve head 142 of the valve member 132 separates from the shoulder 138 of the valve seat 130 to move the valve member 132 to the open position. In the open position of the valve member 132, fluid entering through an inlet 152 of the inlet fluid passage 120 flows along the fluid passage axis 124 and through the inlet valve assembly 126, being drawn into the pressure chamber 118. To flow through the inlet valve assembly 126, the fluid flows through the inlet valve bore 134 and along the valve seat axis 136. The inlet 152 defines a suction port of the fluid end section 104.

During the fluid flow through the inlet valve assembly 126 and into the pressure chamber 118, the outlet valve assembly 128 is in a closed position wherein a seal 154 of a valve member 156 of the outlet valve assembly 128 is sealingly engaged with a shoulder 158 of a valve seat 160 of the outlet valve assembly 128. Fluid continues to be drawn into the pressure chamber 118 until the plunger 114 is at the end of the suction stroke of the plunger 114, wherein the plunger 114 is at the farthest point from the fluid passage axis 124 of the range of motion of the plunger 114.

At the end of the suction stroke of the plunger 114, the differential pressure across the inlet valve assembly 126 is such that the spring 146 of the inlet valve assembly 126 begins to decompress and extend, forcing the valve head 142 of the valve member 132 of the inlet valve assembly 126 to move (relative to the valve seat 130) downward, as viewed in FIG. 2, along the valve seat axis 136 in the direction of arrow 162. As a result, the inlet valve assembly 126 moves to the closed position of the valve member 132 wherein the valve head 142 of the valve member 132 is sealingly engaged with the valve seat 130.

Movement of the plunger 114 in the direction of arrow 164 toward the fluid passage axis 124 and into the pressure chamber 118 will be referred to herein as the discharge stroke of the plunger 114. As the plunger 114 moves along the discharge stroke into the pressure chamber 118, the pressure within the pressure chamber 118 increases. The pressure within the pressure chamber 118 increases until the differential pressure across the outlet valve assembly 128 exceeds a predetermined set point, at which point the outlet valve assembly 128 opens and permits fluid to flow out of the pressure chamber 118 along the fluid passage axis 124, being discharged through an outlet 165 of the fluid end section 104 (through the outlet valve assembly 128). During the discharge stroke of the plunger 114, the valve member 132 of the inlet valve assembly 126 is positioned in the closed position wherein the valve head 142 of the valve member 132 is sealingly engaged with the valve seat 130. The outlet 165 of the fluid end section 104 defines a discharge port of the fluid end section 104.

The fluid cylinder 108 of the fluid end section 104 of the reciprocating pump assembly 100 includes an access port 166. The access port 166 is defined by an opening that extends through a body 168 of the fluid cylinder 108 to provide access to the pressure chamber 118 and thereby internal components of the fluid cylinder 108 (e.g., the inlet valve assembly 126, the outlet valve assembly 128, the plunger 114, etc.) for service (e.g., maintenance, replacement, etc.) thereof. The access port 166 of the fluid cylinder 108 is closed using a suction cover 170 to seal the pressure chamber 118 of the fluid cylinder 108 at the access port 166.

The suction cover 170 may be selectively removed to enable access to the pressure chamber 118 and thereby the internal components of the fluid cylinder 108. In some circumstances (e.g., during field use of the reciprocating pump assembly 100, etc.), it may be desirable to access and thereby service the internal components of the fluid cylinder 108 relatively quickly, for example to limit the downtime of the reciprocating pump assembly 100 wherein the reciprocating pump assembly 100 is non-operational. The capability of servicing the reciprocating pump assembly 100 as quickly as possible and thereby limiting the downtime thereof may improve the profitability of a well service or other operation utilizing the reciprocating pump assembly 100.

The plunger bore 116 is defined by an inner wall 172 of the body 168 of the fluid cylinder 108. In other words, the plunger bore 116 includes the inner wall 172. As shown in FIG. 2, the plunger bore 116 includes a packing segment 174. The plunger rod assembly 112 includes packing 176 that is received within the packing segment 174 of the plunger bore 116 such that the packing 176 extends radially between the plunger 114 and the inner wall 172 to facilitate sealing the plunger 114 within the plunger bore 116 of the fluid cylinder 108.

Figure 3:
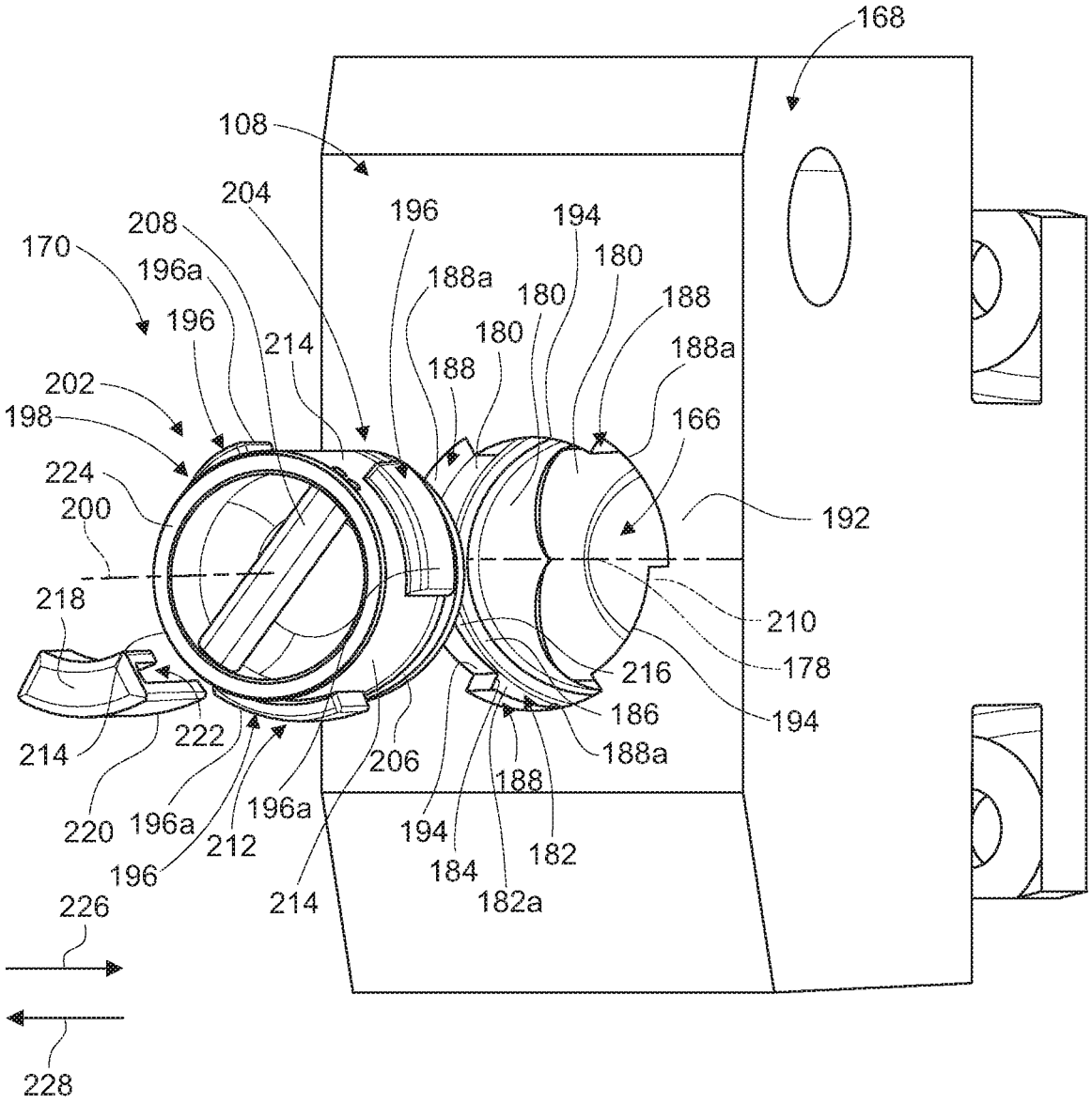
FIG. 3 is an exploded perspective view of a portion of the fluid end section shown in FIG. 2 illustrating a suction cover and an access port of the fluid end section according to an exemplary embodiment.
Figure 4:
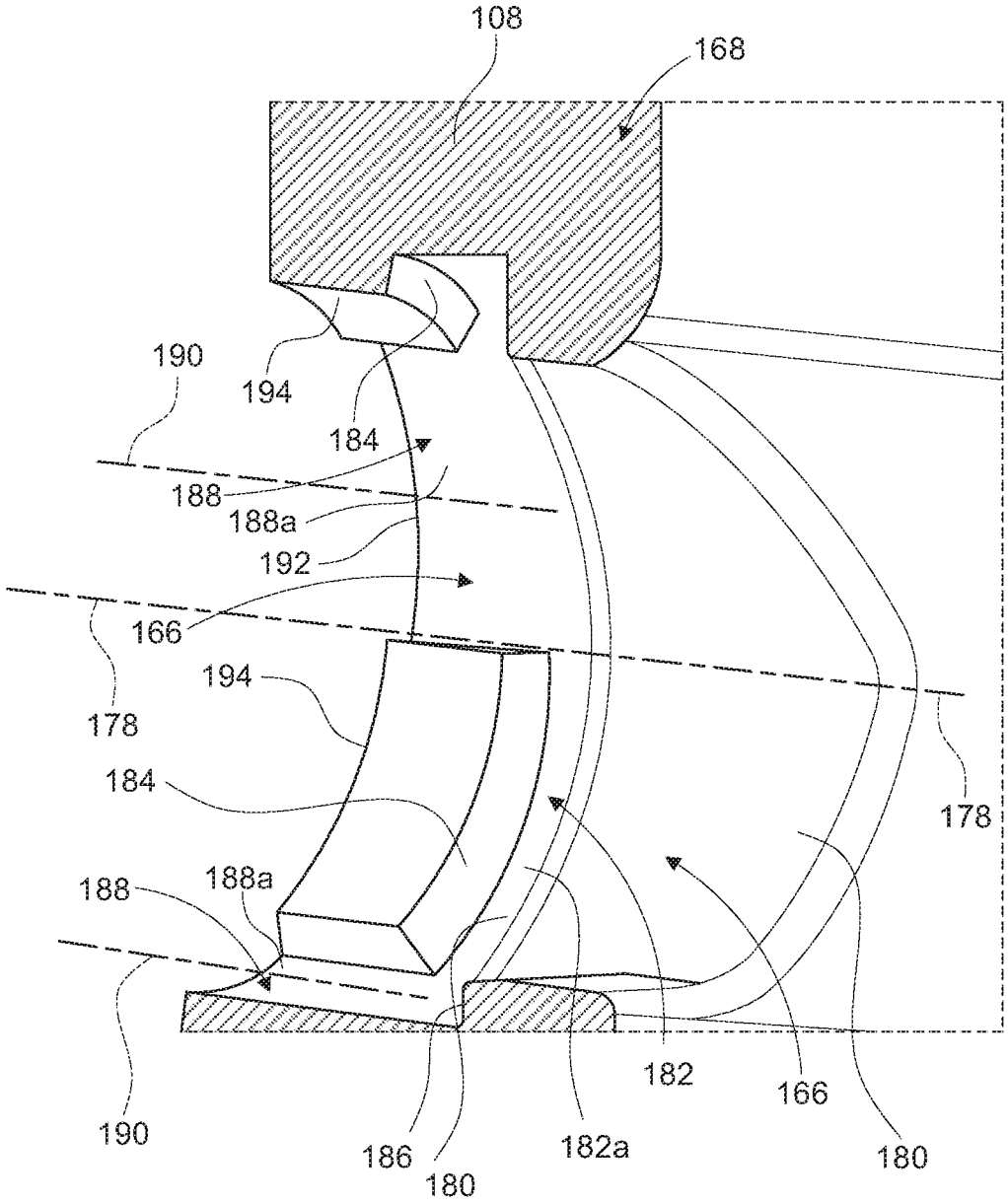
FIG. 4 is a broken away perspective view of a fluid cylinder of the fluid end section shown in FIG. 2 illustrating the access port according to an exemplary embodiment.
Figure 5:
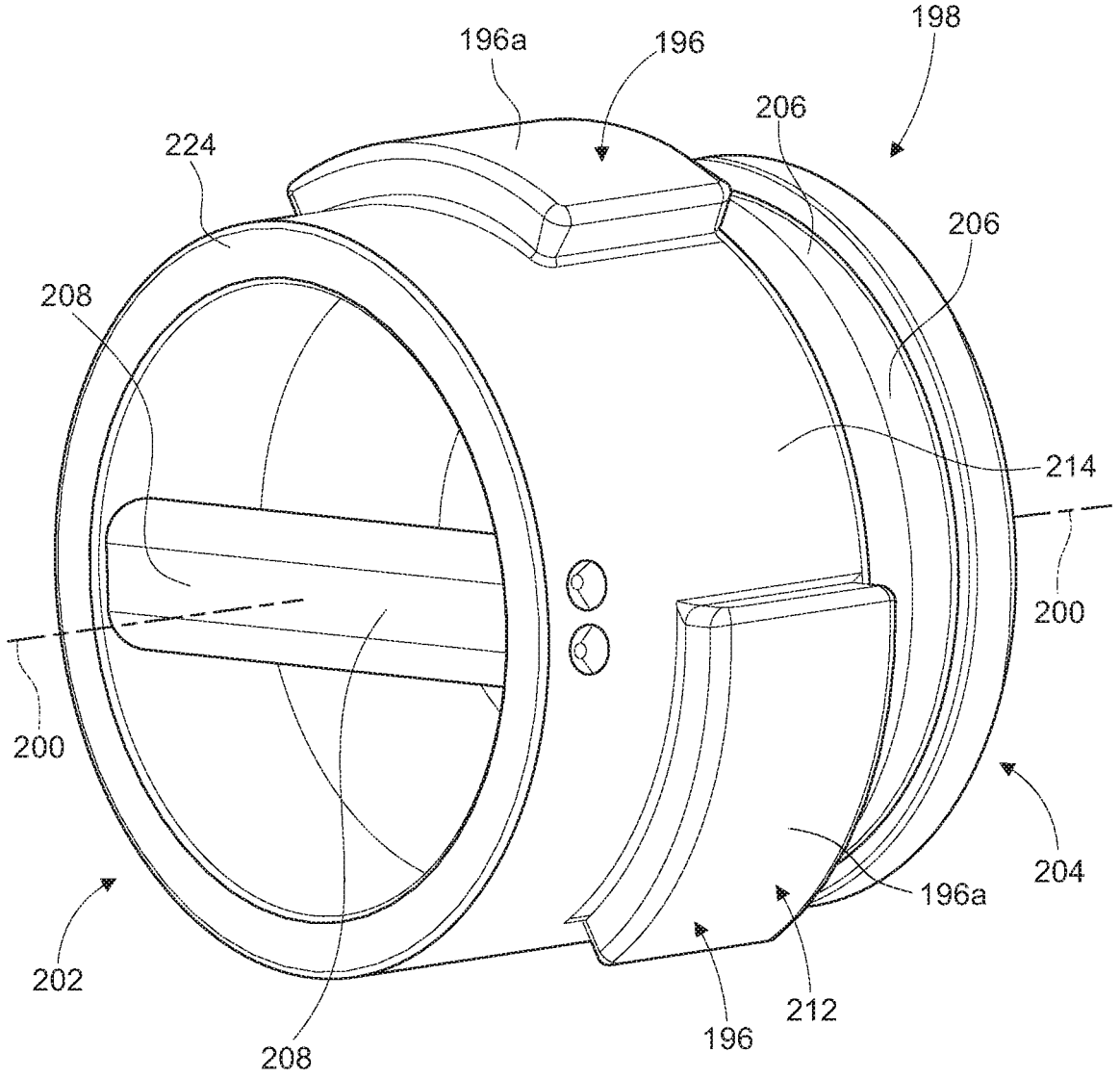
FIG. 5 is a perspective view of the suction cover shown in FIG. 3 according to an exemplary embodiment.

Referring now to FIGS. 3 and 4, the access port 166 of the fluid cylinder 108 extends through the body 168 of the fluid cylinder 108 along a central longitudinal axis 178. The body 168 of the fluid cylinder 108 includes an inner wall 180 that defines the access port 166 (i.e., the access port 166 includes the inner wall 180). The access port 166 includes a keyway 182. For example, the exemplary embodiment of the keyway 182 includes a circumferential groove 182*a* that extends radially (relative to the central longitudinal axis 178) into the inner wall 180 of the fluid cylinder 108. In other words, the exemplary embodiment of the keyway 182 extends radially into the inner wall 180 relative to the central longitudinal axis 178. The circumferential groove 182*a* of the keyway 182 includes opposing sidewalls 184 and 186. In the exemplary embodiment, the side walls 184 and 186 of the circumferential groove 182*a* at an approximately perpendicular angle relative to the central longitudinal axis 178, as can is best seen in FIG. 4. In other embodiments, the side wall 184 and/or the side wall 186 extends at an oblique angle relative to the central longitudinal axis 178. The central longitudinal axis 178 of the access port 166 may be referred to herein as a "central longitudinal port axis".

In the exemplary embodiment, the circumferential groove 182*a* of the keyway 182 extends a continuous length along an approximate entirety of the length of the circumference of the access port 166. But, in some other examples the length of the circumference of the access port is greater than the length of the circumferential groove 182*a* (i.e., the length of the circumferential groove 182*a* extends along only a portion of the circumference of the access port 166). Moreover, and for example, the circumferential groove 182*a* may be broken into a two or more discrete segments that each extend along a corresponding portion (i.e., segment) of the circumference of the access port 166.

The access port 166 includes one or more keyholes 188 that intersect the keyway 182*a*. For example, in the exemplary embodiment, each keyhole 188 includes an axial opening 188*a* that extends a length through the body 168 of the fluid cylinder 108 along a central keyhole axis 190 (not shown in FIG. 3). The length of each axial opening 188*a* extends through an outer surface 192 of the body 168 of the fluid cylinder 108 and through the sidewall 184 of the circumferential groove 182*a* such that the axial opening 188*a* intersects the circumferential groove 182*a*, as is illustrated in FIGS. 3 and 4. As best seen in FIG. 3, the circumference of the access port 166 includes one or more extensions 194 defined between the axial openings 188*a* that extend radially relative to the central longitudinal axis 178 of the access port 166.

In the exemplary embodiment, the central keyhole axis 190 of each axial opening 188*a* extends approximately parallel to the central longitudinal axis 178 of the access port 166 such that the length of each axial opening 188*a* (i.e., the length of each keyhole 188) extends though the body 168 of the fluid cylinder 108 approximately parallel to the central longitudinal axis 178. In other embodiments, the central keyhole axis 190 of one or more of the axial openings 188*a* extends at an oblique angle relative to the central longitudinal axis 178 of the access port 166 such that the length of one or more of the axial openings 188*a* (i.e., the length of one or more of the keyholes 188) extends through the body 168 of the fluid cylinder 108 at an oblique angle relative to the central longitudinal axis 178. Each of the keyholes 188 may be referred to herein as a "first" and/or a "second" keyhole 188. Each of the axial openings 188*a* may be referred to herein as a "first" and/or a "second" axial opening.

In the exemplary embodiment, the access port 166 includes three keyholes 188 (e.g., includes three axial openings 188*a*, etc.). But, the access port 166 may include any number of keyholes 188 and any number of axial openings 188*a*. The sizes and shapes of the axial openings 188*a* shown herein are meant merely as examples. In addition or alternatively to the sizes and shapes shown herein, each axial opening 188*a* may include any other size and/or any other shape. For example, in some other embodiments, one or more of the axial openings 188*a* has a different size and/or shape as compared to one or more other axial openings 188*a*. The size and/or shape of the circumferential groove 182*a* of the keyway 182 that is shown herein is meant merely as one example. In addition or alternatively to the size and shape shown herein, the circumferential groove 182*a* may include any other size and/or any other shape.

In the exemplary embodiment, the axial openings 188*a* are arranged in an exemplary pattern wherein the axial openings 188*a* are spaced approximately evenly apart from each other along the circumference of the access port 166. But, the pattern of the axial openings 188*a* shown herein is meant merely as one example of a pattern of the axial openings 188*a* along the circumference of the access port 166. In addition or alternatively to the pattern shown herein, the arrangement of the axial openings 188*a* may include any other pattern along the circumference of the access port 166. For example, in some other embodiments, the axial openings 188*a* are not distributed evenly (i.e., are spaced unevenly apart) along the circumference of the access port 166.

Various parameters of the keyhole(s) 188 and/or the keyway 182 of the access port 166 may be selected to enable the access port 166 to function as described and/or illustrated herein (e.g., to interlock with the suction cover 170, for example as described below and illustrated in FIGS. 8 and 9; etc.). For example, various parameters of the keyhole (s) 188 and/or the keyway 182 may be selected to enable one or more key(s) 196 (not shown in FIG. 4) of the suction cover 170 to be inserted into the keyway 182 through the keyhole(s) 188. Examples of parameters of the keyhole(s) 188 and/or the keyway 182 of the access port 166 that may be selected to enable the access port 166 to function as described and/or illustrated herein include, but are not limited to, the number of axial openings 188*a*, the number of axial openings 188*a* relative to the number of keys 196 of the suction cover 170, the size of one or more axial openings 188*a*, the size of one or more axial openings 188*a* relative to one or more corresponding keys 196 of the suction cover 170, the shape of one or more axial openings 188*a*, the shape of one or more axial openings 188*a* relative to one or more corresponding keys 196 of the suction cover 170 (e.g., providing an axial opening 188*a* with a complementary shape relative to one or more corresponding keys 196, etc.), the pattern of one or more axial openings 188*a* along the circumference of the access port 166 (e.g., the distance between adjacent axial openings 188*a* along the circumference of the access port 166, etc.), the pattern of one or more axial openings 188*a* along the circumference of the access port 166 relative to the pattern of one or more keys 196 of the suction cover 170, the size of the circumferential groove 182*a* (e.g., the length of the circumferential groove 182*a*, the length of the circumferential groove 182*a* relative to the length of the circumference of the access port 166, the width of the circumferential groove 182*a* defined between the sidewalls 184 and 186, etc.), the size of the circumferential groove 182*a* relative to one or more corresponding keys 196, the shape of the circumferential groove 182*a*, the shape of the circumferential groove 182*a* relative to one or more corresponding keys 196 of the suction cover 170 (e.g., providing the circumferential groove 182*a* with a complementary shape relative to one or more corresponding keys 196, etc.), the number of discrete segments of the circumferential groove 182*a*, the number of discrete segments of the circumferential groove 182*a* relative to the number of keys 196 of the suction cover 170, and/or the like.

Figure 6:
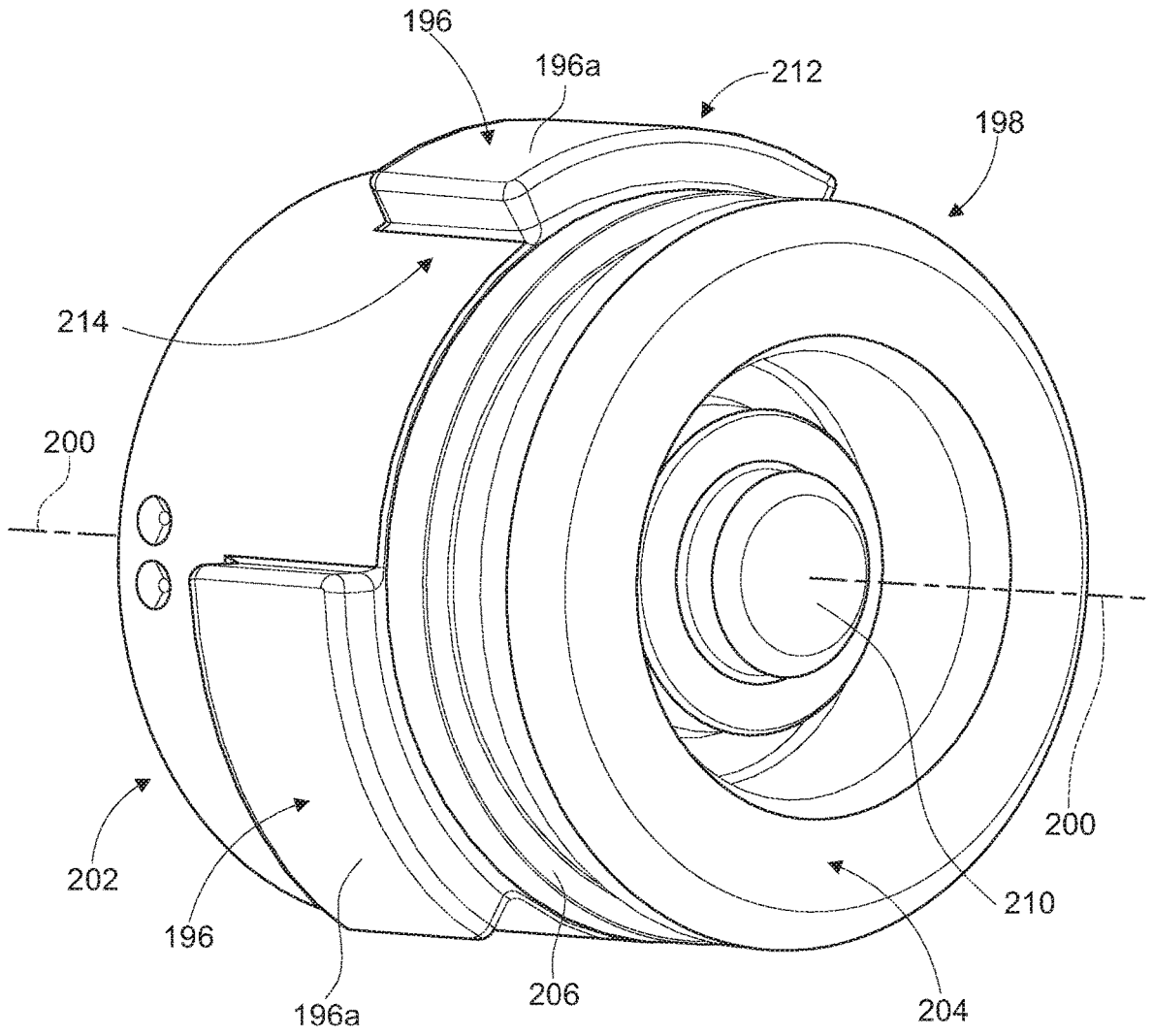
FIG. 6 is another perspective view of the suction cover shown in FIGS. 3 and 5 according to an exemplary embodiment.
Figure 7:
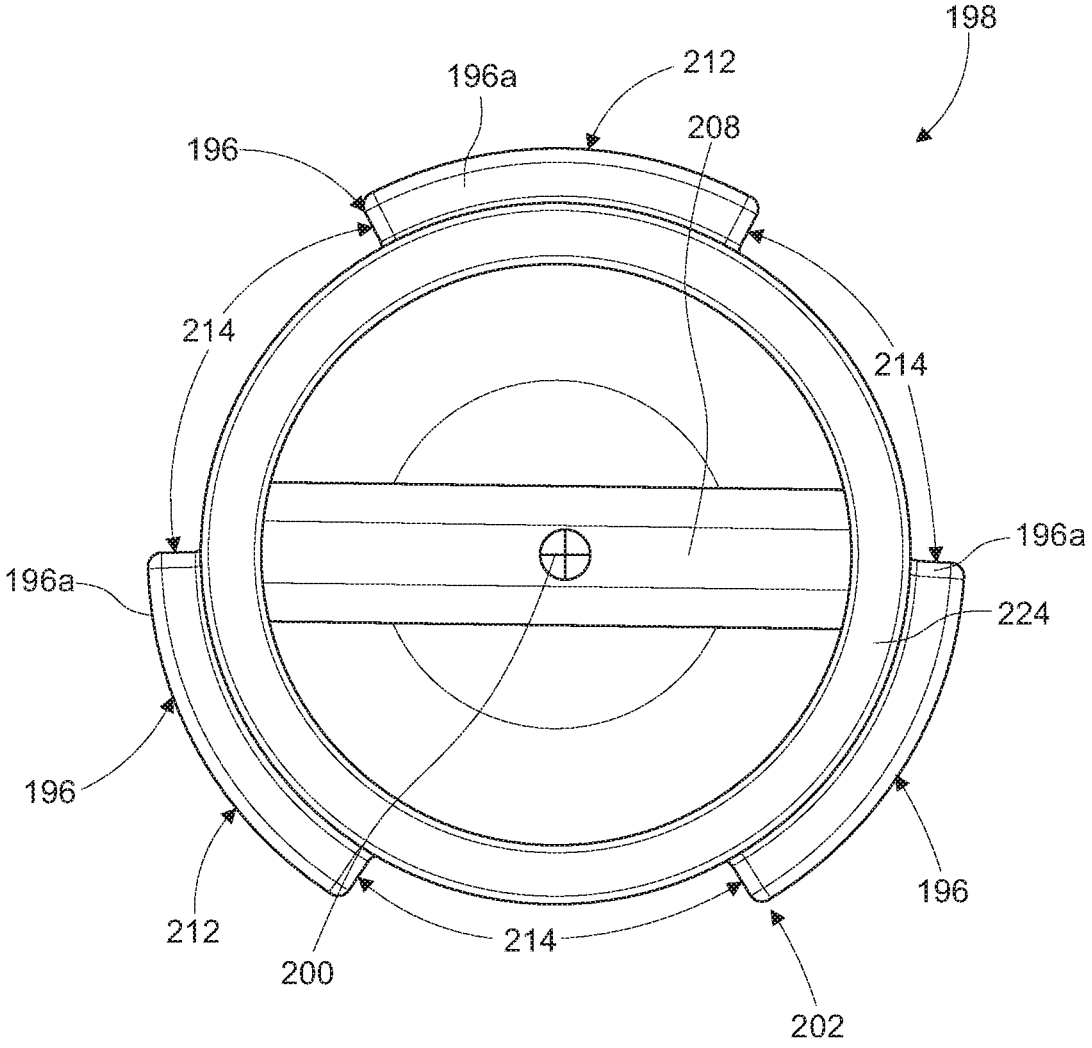
FIG. 7 is an elevational view of the suction cover shown in FIGS. 3, 5, and 6 according to an exemplary embodiment.
Figure 8:
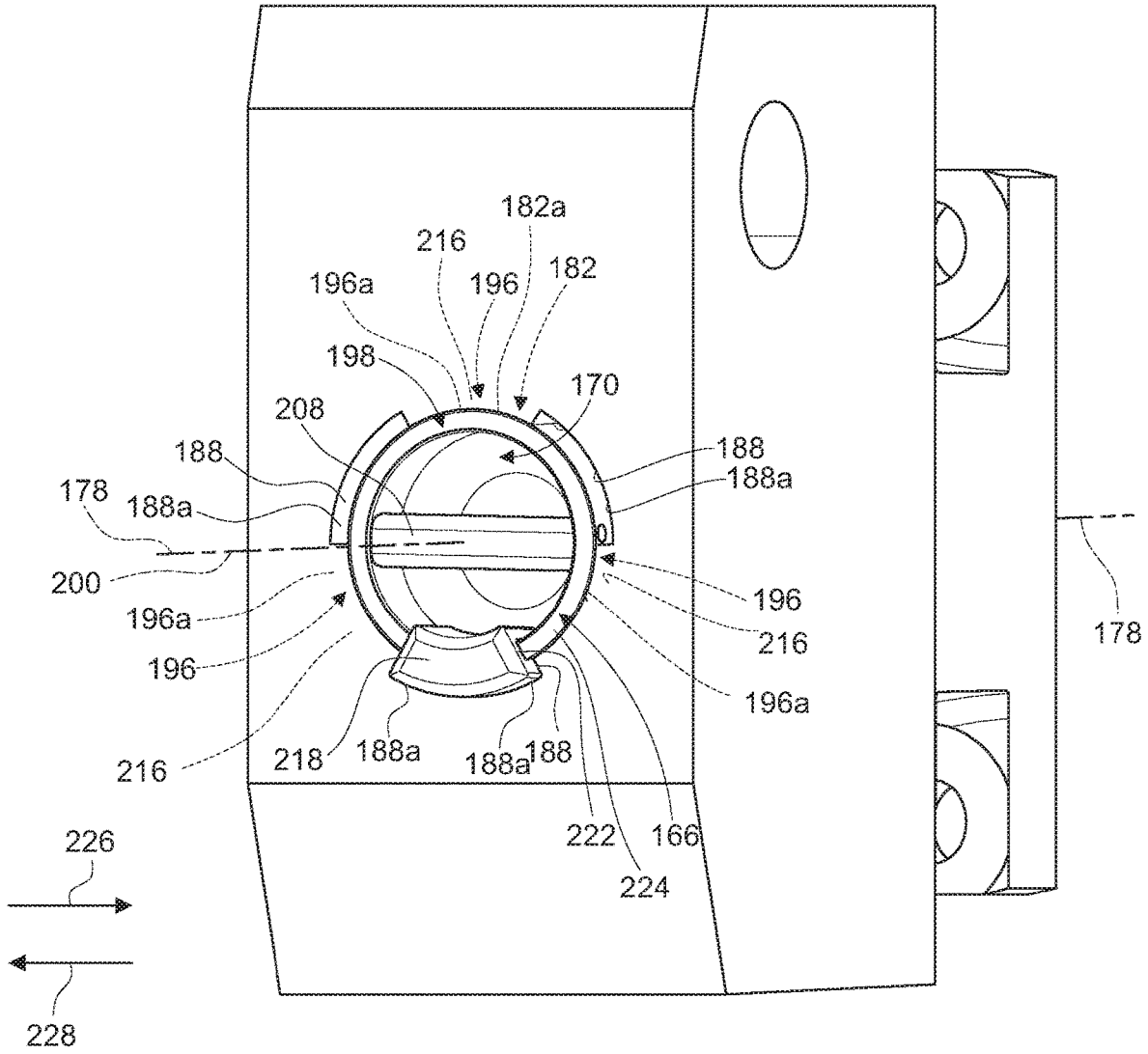
FIG. 8 is a perspective view of the portion of the fluid end section shown in FIG. 3 illustrating the suction cover shown in FIGS. 3 and 5-7 in a locked position according to an exemplary embodiment.
Figure 9:
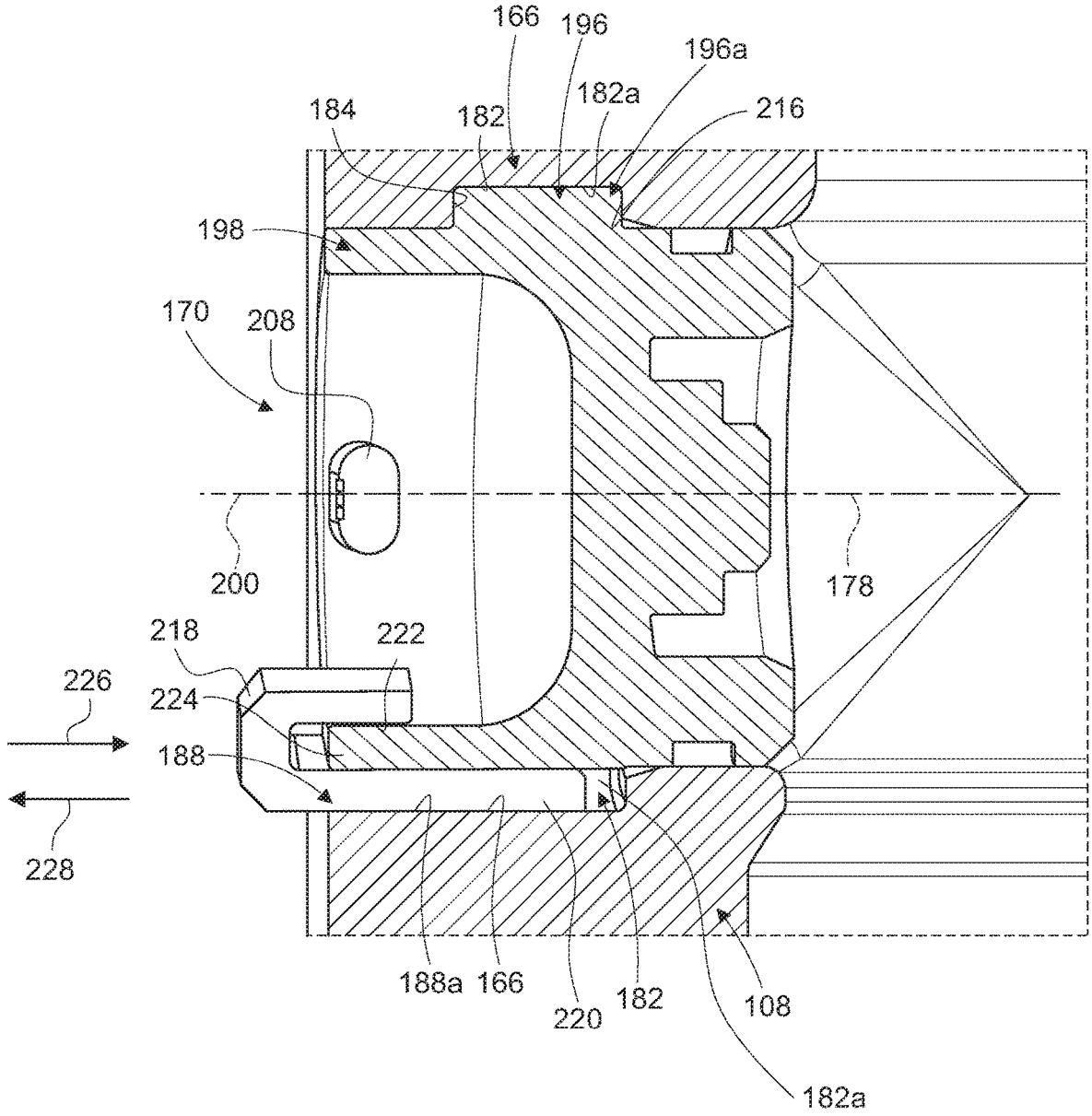
FIG. 9 is a cross-sectional view illustrating the locked position shown in FIG. 8 according to an exemplary embodiment.

Referring now to FIGS. 3 and 5-7, the suction cover 170 includes a plug 198 that is configured to be at least partially received within the access port 166 (not shown in FIGS. 5-7) of the fluid cylinder 108 (not shown in FIGS. 5-7), for example as is shown in FIGS. 8 and 9. The plug 198 extends along a length along a central longitudinal axis 200, which is optionally coaxial with the central longitudinal axis 178 (not shown in FIGS. 5-7) of the access port 166 when the suction cover 170 is held within the access port 166. The plug 198 of the suction cover 170 extends the length along the central longitudinal axis 200 from an end portion 202 to an opposite end portion 204 (not visible in FIG. 7). The plug 198 optionally includes one or more sealing grooves 206 (not visible in FIG. 7) configured to hold a seal (not shown) that sealingly engages the inner wall 180 (not shown in FIGS. 5-7) of the fluid cylinder 108 to facilitate sealing the suction cover 170 to the fluid cylinder 108 within the access port 166.

As will be described in more detail below, the plug 198 of the suction cover 170 is configured to be rotated within the access port 166 between a locked position (e.g., the locked position shown in FIGS. 8 and 9, etc.) that holds the suction cover 188 within the access port 166 (e.g., during operation of the reciprocating pump assembly 100, etc.) and an unlocked position (e.g., the unlocked position shown in FIG. 3, etc.) that enables the suction cover 170 to be removed from the access port 166. Optionally, the end portion 202 of the plug 198 includes a bar 208 (not visible in FIG. 6) that defines a handle of the suction cover 170 that enables an operator to rotate the plug 198 between the locked and unlocked positions and/or that enables the operator to remove the suction cover 170 from the access port 166, for example using a tool and/or the operator's hand. As shown in FIG. 6, the end portion 204 of the plug 198 optionally includes a stop 210 that is configured to be received (e.g., nest, fit, etc.) within a complementary-shaped seat (not shown) of the access port 166. The central longitudinal axis 200 of the plug 198 may be referred to herein as a "central longitudinal plug axis".

The plug 198 of the suction cover 170 includes one or more of the keys 196. For example, in the exemplary embodiment, each key 196 includes a protrusion 196*a* that extends radially outward (relative to the central longitudinal axis 200) from the plug 198. In other words, the exemplary embodiment of each key 196 extends radially outward from the plug 198 relative to the central longitudinal axis 200. Each protrusion 196*a* extends a length radially outward from the plug 198 to an end portion 212 of the protrusion 196*a*. In the exemplary embodiment, the keys 196 are spaced apart along the circumference of the plug 198 by one or more recesses 214 defined between the keys 196, as is best seen in FIG. 7. For example, the protrusions 196*a* are spaced apart along the circumference of the plug 198 by one or more recesses 214 defined between the protrusions 196*a*. Each of the keys 196 may be referred to herein as a "first" and/or a "second" key 196. Each of the protrusions 196*a* may be referred to herein as a "first" and/or a "second" protrusion.

As briefly described above, the protrusion 196*a* of each key 196 is configured to be received through into the keyway 182 (not shown in FIGS. 5-7) through one or more corresponding keyhole(s) 188. As will be described below, the protrusion 196*a* of each key 196 is configured to be received into one or more corresponding locking segments 216 (not shown in FIG. 5-7) of the circumferential groove 182*a* when the plug 198 is rotated from the unlocked position to the locked position to thereby interlock the suction cover 170 with the access port 166.

In the exemplary embodiment, the plug 198 includes three keys 196 (e.g., includes three protrusions 196*a*, etc.). But, the plug 198 may include any number of keys 196 and any number of protrusions 196*a*. The sizes and shapes of the protrusions 196*a* shown herein are meant merely as examples. In addition or alternatively to the sizes and shapes shown herein, each protrusion 196*a* may include any other size and/or any other shape. For example, in some other embodiments, one or more of the protrusions 196*a* has a different size and/or shape as compared to one or more other protrusions 196*a*.

In the exemplary embodiment, the protrusions 196*a* are arranged in an exemplary pattern wherein the protrusions 196*a* are spaced approximately evenly apart from each other along the circumference of the plug. But, the pattern of the protrusions 196*a* shown herein is meant merely as one example of a pattern of the protrusions 196*a* along the circumference of the plug 198. In addition or alternatively to the pattern shown herein, the arrangement of the protrusions 196*a* may include any other pattern along the circumference of the plug 198. For example, in some other embodiments, the protrusions 196*a* are spaced unevenly apart along the circumference of the pug 198 (e.g., one or more recesses has a different size than one or more other recesses 216, etc.).

Various parameters of the key(s) 196 of the plug 198 may be selected to enable the plug 198 to function as described and/or illustrated herein (e.g., to interlock with the access port 166 for example as described below and illustrated in FIGS. 8 and 9, etc.). For example, various parameters of the key(s) 196 may be selected to enable one or more key(s) 196 of the suction cover 170 to be inserted into the keyway 182 through the keyhole(s) 188. Examples of parameters of the key(s) 196 of the plug 198 that may be selected to enable the plug 198 to function as described and/or illustrated herein include, but are not limited to, the number of protrusions 196*a*, the number of protrusions 196*a* relative to the number of axial openings 188*a* of the access port 166, the size of one or more protrusions 196*a*, the size of one or more protrusions 196*a* relative to one or more corresponding axial openings 188*a* of the access port 166, the size of one or more protrusions 196*a* relative to the circumferential groove 182*a* of the access port 166, the shape of one or more protrusions 196*a*, the shape of one or more protrusions relative to one or more corresponding axial openings 188*a* of the access port 166 (e.g., providing a protrusion 196*a* with a complementary shape relative to one or more corresponding axial openings 188*a*, etc.), the shape of one or more protrusions 196*a* relative to the circumferential groove 182*a* of the access port 166 (e.g., providing a protrusion 196*a* with a complementary shape relative to the circumferential groove 182*a*, etc.), the pattern of one or more protrusions 196*a* along the circumference of the plug 198 (e.g., the size of one or more recesses 216, i.e., the distance between adjacent protrusions 196*a* along the circumference of the plug 198; etc.), the pattern of one or more protrusions 196*a* along the circumference of the plug 198 relative to the pattern of one or more axial openings 188*a* of the access port 166, and/or the like. Although the plug 198 is shown as including the same number of keys 196 (e.g., the protrusions 196*a*, etc.) as keyholes 188 (e.g., axial openings 188*a*, etc.) of the access port 166, in other embodiments the access port 166 includes a greater number of keyholes 188 (e.g., axial openings 188*a*, etc.) as compared to the number of keys 196 (e.g., protrusions 196*a*, etc.) of the plug 198.

Referring now solely to FIG. 3, the suction cover 170 optionally includes a locking cuff 218 that is configured to hold the plug 198 in the locked position, as will be described in more detail below. In the exemplary embodiment, the locking cuff 218 includes an extension 220 that is configured to extend within the keyway 182 of access port 166 to hold the plug 198 in the locked position. The exemplary embodiment of the locking cuff 218 also includes a recess 222 that is configured to receive a lip 224 of the plug 198 therein.

In operation, the plug 198 of the suction cover 170 is installed within the access port 166 by orienting the plug 198 such that the keys 196 (e.g., the protrusions 196*a*, etc.) of the plug 198 are aligned with the keyholes 188 (e.g., the axial openings 188*a*, etc.) of the access port 166. The plug 198 is inserted into the access port 166 along the axis 178 in the direction of the arrow 226. As the plug 198 is inserted into the access port 166, the keys 196 (e.g., the protrusions 196*a*, etc.) of the plug 198 are received through the keyholes 188 (e.g., the axial openings 188*a*, etc.) of the access port 166 such that the keys 196 (e.g., the protrusions 196*a*, etc.) extend within the keyway 182 (e.g., the circumferential groove 182*a*, etc.) of the access port 166 when the plug 198 is at least partially received within the access port 166, as should be apparent from the exploded view of FIG. 3. As the keys 196 (e.g., the protrusions 196*a*, etc.) of the plug 198 are received through the keyholes 188 (e.g., the axial openings 188*a*, etc.), the extensions 194 of the access port 166 are received through the recesses 214 defined between the keys 196 (e.g., the protrusions 196*a*, etc.). Once inserted (i.e., at least partially received) into the access port 166 as described immediately above, the plug 198 is in the unlocked position of the plug 198 wherein the keys 196 (e.g., the protrusions 196*a*, etc.) of the plug 198 are aligned with the keyholes 188 (e.g., the axial openings 188*a*, etc.) of the access port 166. Accordingly, in the unlocked position shown in FIG. 3, the plug 198 of the suction cover 170 can be removed from the access port 166 by moving (e.g., pulling on the bar 208, etc.) the plug 198 along the axis 178 in the direction of the arrow 228.

To lock the suction cover 170 within the access port 166, the plug 198 of the suction cover 170 is rotated within the access port 166 (e.g., about the axis 178, about the axis 200, etc.) from the unlocked position shown in FIG. 3 to the exemplary locked position shown in FIGS. 8 and 9. As the plug 198 rotates within the access port 166 from the unlocked position to the locked position, the keys 196 (e.g., the protrusions 196*a*, etc.) of the plug 198 move (i.e., are at least partially received) into the locking segments 216 of the keyway 182 (e.g., the circumferential groove 182*a*, etc.) of the access port 166. In the locked position of the plug 198 wherein the keys 196 (e.g., the protrusions 196*a*, etc.) of the plug 198 are at least partially received into the locking segments 216 of the keyway 182 (e.g., the circumferential groove 182*a*, etc.), the keys 196 (e.g., the protrusions 196*a*, etc.) are at least partially misaligned with the keyholes 188 (e.g., the axial openings 188*a*, etc.). Accordingly, in the locked position of the plug 198, the sidewall 184 (not visible in FIG. 8) of the keyway 182 (e.g., the circumferential groove 182*a*, etc.) blocks the keys 196 (e.g., the protrusions 196*a*, etc.) from backing out of the access port 166 through the keyholes 188 (e.g., the axial openings 188*a*, etc.) in the direction 228. The keys 196 (e.g., the protrusions 196*a*, etc.)

are thus configured to interlock the plug 198 of the suction cover 170 with the access port 166 in the locked position of the plug 198 such that the locked position of the plug 198 holds the plug 198 of the suction cover 170 within the access port 166 (i.e., prevents the plug 198 from backing out of the access port 166 in the direction 228), for example during operation of the reciprocating pump assembly 100, etc.

Although the plug 198 is shown as moving from the unlocked position to the locked position by rotating the plug 198 in a clockwise direction, in the exemplary embodiment the plug 198 is also configured to rotate from the unlocked position to the locked position in a counterclockwise direction.

Optionally, the plug 198 of the suction cover 170 is held in the locked position using the locking cuff 218. For example, when the plug 198 is in the locked position, the locking cuff 218 is inserted through a keyhole 188 (e.g., an axial opening 188*a*, etc.) of the access port 166 such that the extension 220 (not visible in FIG. 8) of the locking cuff 218 extends into the keyway 182 (e.g., the circumferential groove 182*a*, etc.) of the access port 166. When received through the keyhole 188 (e.g., the axial opening 188*a*, etc.) such that the extension 218 extends within the keyway 182 (e.g., the circumferential groove 182*a*, etc.) as shown in FIGS. 8 and 9, the extension 220 of the locking cuff 218 blocks one or more of the keys 196 (e.g., the protrusions 196*a*, etc.) from rotating in a clockwise direction and/or a counter-clockwise direction. Accordingly, when received into the keyway 182 (e.g., the circumferential groove 182*a*, etc.), the extension 218 of the locking cuff 218 prevents the plug 198 from rotating from the locked position to the unlocked position (i.e., holds the plug 198 in the locked position).

In the exemplary embodiment, the recess 222 of the locking cuff 218 receives the lip 224 of the plug 198 with an interference fit to thereby hold the locking cuff 218 in place within the access port 166. But, in addition or alternative to the interference fit between the locking cuff 218 and the lip 224, the locking cuff 218 may be held in place within the access port 166 using any other suitable method, structure, means, fastener, connection type, and/or the like, such as, but not limited to, an adhesive, a latch, a clip, a threaded fastener, a pin, and/or the like.

To remove the plug 198 of the suction cover 170 from the access port 166, the locking cuff 218 (if used, provided, etc.) is removed from the access port 166 by moving (e.g., pulling, etc.) the locking cuff 218 out of the keyhole 188 (e.g., the axial opening 188*a*, etc.) in the direction 228. The plug 198 can then be rotated within the access port 166 (e.g., in a clockwise direction or a counterclockwise direction, etc.) from the locked position shown in FIGS. 8 and 9 to the unlocked position shown in FIG. 3. Once rotated to the unlocked position, the plug 198 of the suction cover 170 can be removed from the access port 166 by moving (e.g., pulling on the bar 208, etc.) the plug 198 along the axis 178 in the direction 228.

In some embodiments, the bar 208 defines a handle of the plug 198 that enables an operator to rotate the plug 198 within the access port 166 between the unlocked and locked positions, to move the plug 198 in the direction 226 to thereby insert the plug 198 into the access port 166, and/or to move the plug 198 in the direction 228 to thereby remove the plug 198 from the access port 166, for example using a tool and/or the operator's hand.

In the exemplary embodiment, the locking cuff 218 is sized such that the locking cuff 218 enables little to no rotation of the plug 198 when the locking cuff 218 is installed within the access port 166 as shown in FIGS. 8 and 9. In other embodiments, the locking cuff 218 has a size that enables some rotation of the plug 198 within the access port 166 but prevents the plug 198 from rotating to the unlocked position.

In addition or alternative to using the locking cuff 218 to hold the plug 198 in the locked position, in some other embodiments an end portion (not shown) of the length of the keyway 182 (e.g., the circumferential groove 182*a*, etc.) prevents one or more of the keys 196 (e.g., the protrusions 196*a*, etc.) from sufficiently rotating in a clockwise direction and/or a counter-clockwise direction to the unlocked position.

The configuration of the protrusions 196*a* of the plug 198, the axial openings 188*a* of the access port 166, and the circumferential groove 182*a* of the access port 166 to enable the plug 198 of the suction cover 170 to be interlocked with the access port 166 is meant as exemplary only. The key(s) 196 of the plug 198, the keyholes 188 of the access port 166, and the keyway 182 of the access port 166 each may have any other configuration that enables the plug 198 to be releasably interlocked with the access port 166. For example, in one alternative embodiment, the keyholes 188 and keyway 182 define a bayonet-type connection wherein the keyholes 188 and/or keyway 182 extend along a helical path along the central longitudinal axis 178 of the access port 166, with an optional bend, notch, and/or the like at an end portion of the keyway 182 acting as a latch that holds the plug 198 of the suction cover 170 in a locked position.

Various embodiments disclosed herein eliminate a threaded connection between a suction cover assembly and a fluid cylinder of a reciprocating pump assembly. Various embodiments disclosed herein provide a reciprocating pump assembly that may require less service and/maintenance, which may limit the downtime of the reciprocating pump assembly and/or reduce costs thereby improving the profitability of a well service or other operation utilizing the reciprocating pump assembly.

The following clauses describe further aspects of the disclosure:

Clause Set A:

A1. A suction cover for a reciprocating pump assembly, said suction cover comprising:

a plug configured to be at least partially received within an access port of a fluid cylinder of the reciprocating pump assembly, the plug comprising at least one key configured to be received through a keyhole of the access port such that the at least one key extends within a keyway of the access port when the plug is at least partially received within the access port, wherein the plug is configured to be rotated within the access port between an unlocked position wherein the at least one key is aligned with the keyhole and a locked position that prevents the plug from backing out of the access port.

A2. The suction cover of clause A1, wherein the at least one key is configured to be at least partially misaligned with the keyhole in the locked position of the plug.

A3. The suction cover of clause A1, wherein the locked position of the plug is configured such that a sidewall of the keyway of the access port blocks the at least one key from backing out of the access port in the locked position of the plug.

A4. The suction cover of clause A1, wherein the at least one key is configured to interlock the plug with the access port in the locked position of the plug.

A5. The suction cover of clause A1, wherein the plug extends a length along a central longitudinal axis, the at least one key extending radially outward from the plug relative to the central longitudinal axis.

A6. The suction cover of clause A1, wherein the plug extends a length along a central longitudinal axis, the suction cover further comprising a locking cuff that is configured to be received through the keyhole of the access port when the plug is in the locked position such that the locking cuff extends within the keyway of the access port, the locking cuff being configured to block the at least one key from rotating about the central longitudinal axis in at least one direction when the locking cuff extends within the keyway of the access port.

A7. The suction cover of clause A1, wherein the at least one key comprises first and second keys that are spaced apart along a circumference of the plug by a recess defined between the first and second keys, the keyhole of the access port including first and second keyholes, wherein the recess is configured to receive an extension of the access port therethrough as the first and second keys are received through the first and second keyholes, respectively.

Clause Set B:

B1. A fluid end section for a reciprocating pump assembly, the fluid end section comprising:

a fluid cylinder comprising a pressure chamber and an access port, the access port extending into the fluid cylinder along a central longitudinal axis, the access port comprising a circumferential groove and an axial opening that intersects the circumferential groove; and a suction cover comprising a plug configured to be at least partially received within the access port of the fluid cylinder, the plug comprising at least one protrusion configured to be received through the axial opening of the access port such that the at least one protrusion extends within the circumferential groove of the access port when the plug is at least partially received within the access port, wherein the plug is configured to be rotated within the access port between an unlocked position wherein the at least one protrusion is aligned with the axial opening and a locked position that prevents the plug from backing out of the access port.

B2. The fluid end section of clause B1, wherein the central longitudinal axis of the access port is a central longitudinal port axis, the plug of the suction cover extending a length along a central longitudinal plug axis, the at least one protrusion extending radially outward from the plug relative to the central longitudinal plug axis.

B3. The fluid end section of clause B1, wherein the access port of the fluid cylinder comprises an inner wall of the fluid cylinder, the circumferential groove of the access port extending radially into the inner wall relative to the central longitudinal axis of the access port.

B4. The fluid end section of clause B1, wherein the axial opening of the access port extends a length through the fluid cylinder that is approximately parallel to the central longitudinal axis of the access port.

B5. The fluid end section of clause B1, wherein the circumferential groove of the access port comprises a sidewall that blocks the at least one protrusion of the suction cover from backing out of the access port in the locked position of the plug.

B6. The fluid end section of clause B1, wherein the suction cover further comprises a locking cuff that is configured to be received through the axial opening of the access port when the plug is in the locked position such that the locking cuff extends within the circumferential groove of the access port, the locking cuff being configured to block the at least one protrusion from rotating about the central longitudinal axis in at least one direction when the locking cuff extends within the circumferential groove of the access port.

Clause Set C:

C1. A fluid end section for a reciprocating pump assembly, the fluid end section comprising:

a fluid cylinder comprising a pressure chamber and an access port, the access port comprising a keyway and a keyhole that intersects the keyway; and a suction cover comprising a plug configured to be at least partially received within the access port of the fluid cylinder, the plug comprising at least one key configured to be received through the keyhole of the access port such that the at least one key extends within the keyway of the access port when the plug is at least partially received within the access port, wherein the plug is configured to be rotated within the access port between an unlocked position wherein the at least one key is aligned with the keyhole of the access port and a locked position wherein the at least one key is at least partially misaligned with the keyhole.

C2. The fluid end section of clause C1, wherein the keyway of the access port comprises a sidewall that blocks the at least one key of the suction cover from backing out of the access port in the locked position of the plug of the suction cover.

C3. The fluid end section of clause C1, wherein the plug of the suction cover extends a length along a central longitudinal axis, the at least one key of the suction cover extending radially outward from the plug relative to the central longitudinal axis.

C4. The fluid end section of clause C1, wherein the suction cover further comprises a locking cuff that is configured to be received through the keyhole of the access port when the plug is in the locked position such that the locking cuff extends within the keyway of the access port, wherein the locking cuff is configured to hold the plug in the locked position when the locking cuff extends within the keyway of the access port.

C5. The fluid end section of clause C1, wherein the at least one key of the suction cover comprises first and second keys that are spaced apart along a circumference of the plug of the suction cover by a recess defined between the first and second keys, the keyhole of the access port including first and second keyholes, wherein the recess is configured to receive an extension of the access port therethrough as the first and second keys are received through the first and second keyholes, respectively.

C6. The fluid end section of clause C1, wherein the access port of the fluid cylinder extends into the fluid cylinder along a central longitudinal axis, the access port comprising an inner wall of the fluid cylinder, the keyway of the access port extending radially into the inner wall relative to the central longitudinal axis of the access port.

C7. The fluid end section of clause C1, wherein the access port of the fluid cylinder extends into the fluid cylinder along a central longitudinal axis, the keyhole of the access port extending a length through the fluid cylinder that is approximately parallel to the central longitudinal axis of the access port.

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise", "left" and right", "front" and "rear", "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. For example, in this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised", "comprises", "having", "has", "includes", and "including" where they appear. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property can include additional elements not having that property. The term "exemplary" is intended to mean "an example of" The phrase "one or more of the following: A, B, and C" means "at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U. S. C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations may be performed in any order, unless otherwise specified, and examples of the disclosure may include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A suction cover for a reciprocating pump assembly, said suction cover comprising:

a plug configured to be at least partially received within an access port of a fluid cylinder of the reciprocating pump assembly, the plug comprising at least one key that includes at least one protrusion, and at least one recess, wherein the at least one protrusion extends radially outward from an exterior surface of the plug and defines a pair of lateral sidewalls, a proximal sidewall, and a distal sidewall, and the at least one recess is defined on the exterior surface of the plug between the lateral sidewalls, the at least one key being configured to be received through a keyhole of the access port such that the at least one key extends within a keyway of the access port when the plug is at least partially received within the access port, wherein the plug is configured to be rotated within the access port between an unlocked position wherein the at least one key is aligned with the keyhole and a locked position that prevents the plug from backing out of the access port.

2. The suction cover of claim 1, wherein the at least one key is configured to be at least partially misaligned with the keyhole in the locked position of the plug.

3. The suction cover of claim 1, wherein the keyhole includes at least one axial opening bounded on either side by an extension, and wherein the locked position of the plug is configured such that a sidewall of the extension of the keyway opposes the proximal sidewall of the at least one protrusion and blocks the at least one key from backing out of the access port in the locked position of the plug.

4. The suction cover of claim 1, wherein the at least one key is configured to interlock the plug with the access port in the locked position of the plug.

5. The suction cover of claim 1, wherein the plug extends a length along a central longitudinal axis, and the central longitudinal axis of the plug is coaxial to a central longitudinal axis of the access port when the plug is at least partially received within the access port.

6. The suction cover of claim 1, wherein the plug extends a length along a central longitudinal axis, the suction cover further comprising a locking cuff that is configured to be received through the keyhole of the access port when the plug is in the locked position such that the locking cuff extends within the keyway of the access port, the locking cuff being configured to block the at least one key from rotating about the central longitudinal axis in at least one direction when the locking cuff extends within the keyway of the access port.

7. The suction cover of claim 1, wherein the keyhole includes at least one axial opening bounded on either side by an extension, wherein the keyhole of the access port including first and second keyholes, wherein the at least one protrusion includes a first protrusion and a second protrusion, and wherein the at least one recess of the plug is configured to receive the extension of the access port therethrough as the first protrusion and the second protrusion are received through the first and second keyholes, respectively.

8. A fluid end section for a reciprocating pump assembly, the fluid end section comprising:

a fluid cylinder comprising a pressure chamber and an access port, the access port extending into the fluid cylinder along a central longitudinal axis, the access port comprising a plurality of axial openings spaced around a circumference of the access port, and a plurality of extensions that extend radially inward toward the central longitudinal axis; and a suction cover comprising a plug configured to be at least partially received within the access port of the fluid cylinder, the plug comprising a plurality of protrusions configured to be received through the plurality of axial openings of the access port such that the plurality of protrusions extend within the access port when the plug is at least partially received within the access port, wherein the plug is configured to be rotated within the access port between an unlocked position where each protrusion is aligned with a respective axial opening of the plurality of axial openings, and a locked position where an opposing sidewall surface of each extension blocks an opposing sidewall surface of a respective protrusion in an axial direction, preventing removal of the plug.

9. The fluid end section of claim 8, wherein the central longitudinal axis of the access port is a central longitudinal port axis, the plug of the suction cover extending a length along a central longitudinal plug axis, and the plurality of protrusions extending radially outward from the plug relative to the central longitudinal plug axis.

10. The fluid end section of claim 8, wherein the access port of the fluid cylinder comprises an inner wall of the fluid cylinder and a circumferential groove of the access port extends radially into the inner wall relative to the central longitudinal axis of the access port.

11. The fluid end section of claim 8, wherein each of the plurality of axial openings of the access port extends a length through the fluid cylinder that is approximately parallel to the central longitudinal axis of the access port.

12. The fluid end section of claim 8, wherein, when the plug is at least partially inserted into an individual axial opening of the plurality of axial openings, the individual axial opening intersects with a circumferential groove of the access port.

13. The fluid end section of claim 8, wherein the suction cover further comprises a locking cuff that is configured to be received through an individual axial opening of the access port when the plug is in the locked position such that the locking cuff extends within a circumferential groove of the access port, the locking cuff being configured to block at least one protrusion of the plurality of protrusions from rotating about the central longitudinal axis in at least one direction when the locking cuff extends within the circumferential groove of the access port.

14. A fluid end section for a reciprocating pump assembly, the fluid end section comprising:

a fluid cylinder comprising a pressure chamber and an access port, the access port comprising a keyway and a keyhole that intersects the keyway; and a suction cover comprising a plug configured to be at least partially received within the access port of the fluid cylinder, the plug comprising a handle in a hollow portion of the plug and at least one key, where the at least one key is configured to be received through the keyhole of the access port such that the at least one key extends within the keyway of the access port when the plug is at least partially received within the access port, wherein the plug is configured to be rotated within the access port, by the handle, between an unlocked position wherein the at least one key is aligned with the keyhole of the access port and a locked position wherein the at least one key is at least partially misaligned with the keyhole.

15. The fluid end section of claim 14, wherein the keyway of the access port comprises a sidewall that blocks the at least one key of the suction cover from backing out of the access port in the locked position of the plug of the suction cover.

16. The fluid end section of claim 14, wherein the plug of the suction cover extends a length along a central longitudinal axis, the at least one key of the suction cover extending radially outward from the plug relative to the central longitudinal axis.

17. The fluid end section of claim 14, wherein the suction cover further comprises a locking cuff that is configured to be received through the keyhole of the access port when the plug is in the locked position such that the locking cuff extends within the keyway of the access port, wherein the locking cuff is configured to hold the plug in the locked position when the locking cuff extends within the keyway of the access port.

18. The fluid end section of claim 14, wherein the at least one key of the suction cover comprises first and second keys that are spaced apart along a circumference of the plug of the suction cover by a recess defined between the first and second keys, the keyhole of the access port including first and second keyholes, wherein the recess is configured to receive an extension of the access port therethrough as the first and second keys are received through the first and second keyholes, respectively.

19. The fluid end section of claim 14, wherein the access port of the fluid cylinder extends into the fluid cylinder along a central longitudinal axis, the access port comprising an inner wall of the fluid cylinder, the keyway of the access port extending radially into the inner wall relative to the central longitudinal axis of the access port.

20. The fluid end section of claim 14, wherein the access port of the fluid cylinder extends into the fluid cylinder along a central longitudinal axis, the keyhole of the access port extending a length through the fluid cylinder that is approximately parallel to the central longitudinal axis of the access port.

* * * * *